United States Patent [19]

Flodén

[11] 4,148,439

[45] Apr. 10, 1979

[54] METHOD AND DEVICE FOR CONTROLLING THE ENERGY CONSUMPTION IN A PULP REFINING SYSTEM

[75] Inventor: Mats Flodén, Täby, Sweden

[73] Assignee: Defibrator Aktiebolag, Stockholm, Sweden

[21] Appl. No.: 762,665

[22] Filed: Jan. 26, 1977

[30] Foreign Application Priority Data

Jan. 30, 1976 [SE] Sweden ..... 7601019

[51] Int. Cl.[2] ..... B02C 23/40

[52] U.S. Cl. ..... 241/28; 241/33; 241/34

[58] Field of Search ..... 241/28, 30, 33, 34, 241/36, 37

[56] References Cited

U.S. PATENT DOCUMENTS

| | | | |
|---|---|---|---|
| 2,561,043 | 7/1951 | Ayers | 241/33 |
| 3,309,031 | 3/1967 | McMahon et al. | 241/37 |
| 3,617,006 | 11/1971 | Jones | 241/34 |

FOREIGN PATENT DOCUMENTS

| | | | |
|---|---|---|---|
| 2145096 | 1/1973 | Fed. Rep. of Germany | 241/37 |

*Primary Examiner*—Granville Y. Custer, Jr.
*Attorney, Agent, or Firm*—Eric Y. Munson

[57] ABSTRACT

Method and apparatus for coordinating the rate of feed and the moisture content of the pulp material to the heat quotients of the mechanical energy input in a refiner system in which the moisture-containing pulp material is introduced at an adjustable rate of feed into the central portion of an axially adjustable grinding space defined between a pair of grinding discs which rotate relative to one another within a closed housing and in which grinding space the material is propelled by centrifugal force created by the rotation of the discs in an annular radial path toward the periphery of the discs while being subjected to a grinding operation in an environment of steam generated by the heat produced by friction in the grinding space. The heat quotients of the mechanical energy are sensed as the pulp material progresses along its radial annular path in the grinding space and the rate of feed and moisture content of the material and the width of the grinding space are coordinated to the sensed heat quotients to produce pulp of optimum values with minimized consumption of mechanical energy.

2 Claims, 4 Drawing Figures

METHOD AND DEVICE FOR CONTROLLING THE ENERGY CONSUMPTION IN A PULP REFINING SYSTEM

BACKGROUND OF THE INVENTION

The present invention concerns a method for use in the beating or refining of fibrous material by the mutual relative rotation of discs, for the purpose of determining and regulating the amount of energy transferred from the discs to the pulp. The invention is also concerned with a device for carrying out the method.

To ensure good pulp quality when grinding or refining fibrous material, the disturbances that occur for one reason or another in the operating conditions must be continually corrected by constant adjustment of the various process parameters to their optimum values, e.g. by adjusting the water feed to achieve a greater or lesser cooling effect, altering the pulp feed rate, resetting the clearance between the discs, or some combination of these measures. An essential prerequisite for carrying out the necessary adjustments and corrections is an exact determination of the total energy transferred to the pulp, and of the distribution of the transferred energy over the surface of the discs. Hitherto it has not been possible to determine these factors satisfactorily.

SUMMARY OF THE INVENTION

The present invention provides a method for quick and accurate determination and regulation of both the total energy transferred by the discs to the pulp, and the distribution of this energy over the surfaces of the discs, achieved by continuously sensing the heat quotients of the energy input along the radial path of the pulp material as it is propelled from the inner central portion of the discs toward the periphery thereof and coordinating the rate of feed and moisture content of the pulp material and the width of the grinding space to the sensed heat quotients.

BRIEF DESCRIPTION OF THE DRAWINGS

Further characteristic of the method of the invention and characteristics of a device designed in accordance with the invention to carry out the method will be apparent from the claims and from the following description, with reference to the accompanying drawings, of an embodiment presented as an example of a device for carrying out the method.

DESCRIPTION OF AN EMBODIMENT OF THE INVENTION

Figure 1:
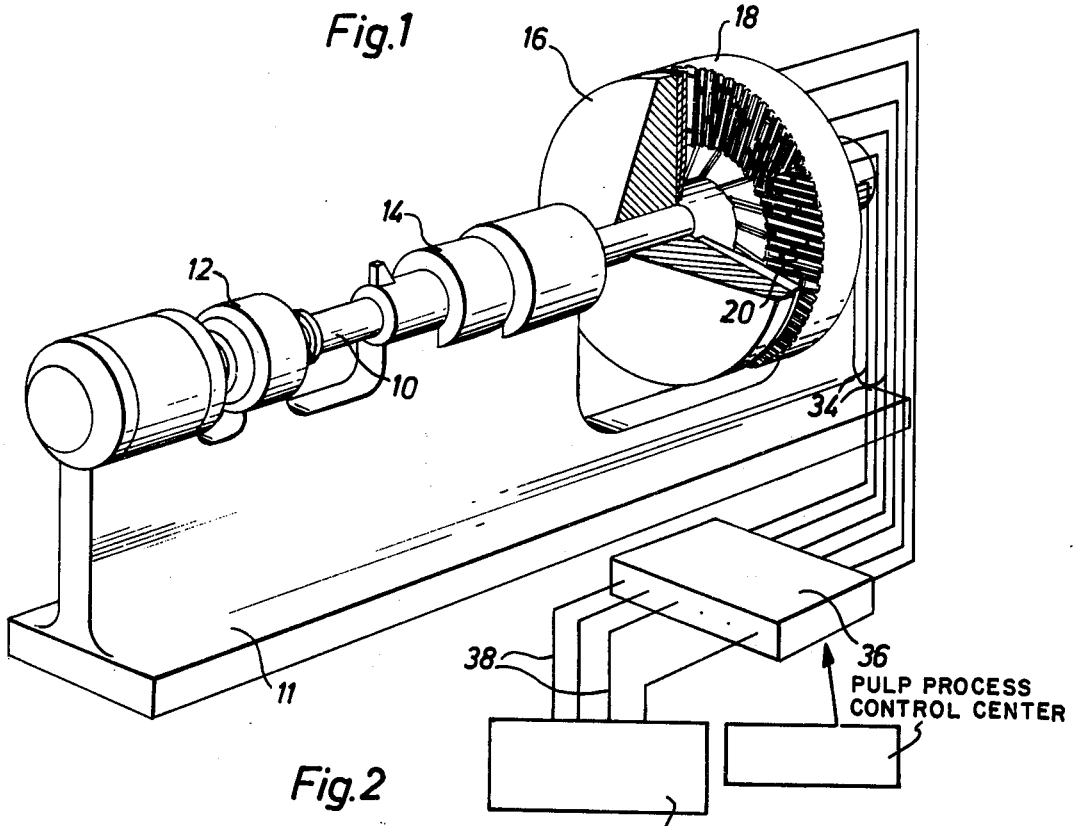
FIG. 1 is a perspective view of the parts of a beating or refining machine that are essential to an explanation of the invention.

The invention is illustrated in the drawings in conjunction with a grinding machine in the form of a refiner for processing fibrous material, comprising a shaft 10 supported by bearings 12 and 14 in a schematically shown frame 11. One end of the shaft 10 supports a grinding disc 16. The bearing housings 12, 14 are so arranged in the frame 11 that the shaft is axially displaceable parallel to its axis, so that the refining disc 16 that rotates with the shaft 10 can move towards and away from a stationary disc 18, which is also mounted on the frame 10. Inasmuch as the disc 16 is axially displaceable with respect to the stationary disc 18, the disc clearance can be varied. During operation, the refining discs are enclosed in a housing (not shown). The grinding machine described is of a conventional type, and for a closer description of the parts essential to its construction and functioning we refer to, e.g., U.S. Pat. No. 3,212,721, where these parts are explained.

Figure 2:
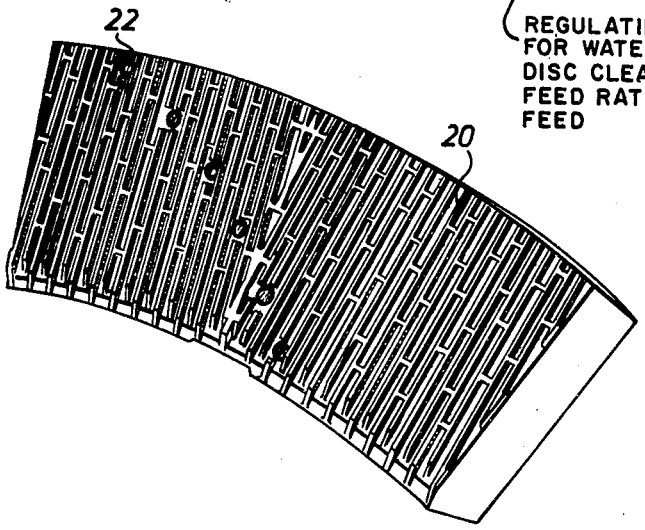
FIG. 2 shows a segment of one of the discs of the beating machine of FIG. 1.
Figure 3:
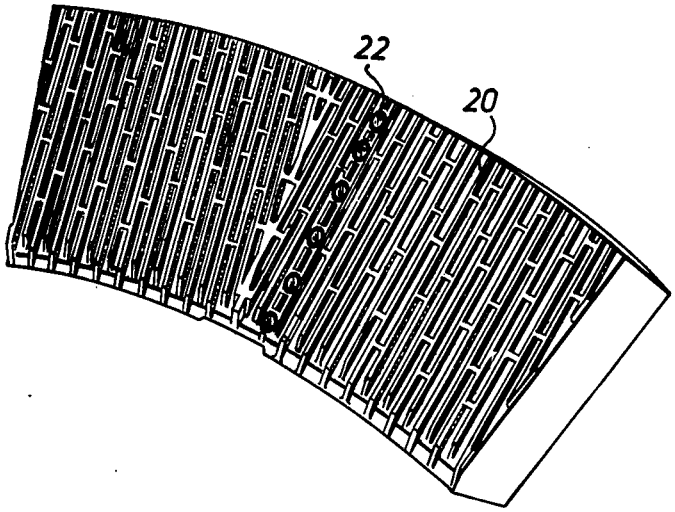
FIG. 3 shows a view similar to FIG. 2 of another embodiment.

According to the invention, the grinding segment 20 of the stationary grinding disc, also appearing in FIGS. 2 and 3, is equipped with a number of radially spaced sensor units 22 by which the temperature, pressure, or any other variable indicating the condition of the pulp and its environment can be measured at every point along the path of the pulp from the center or inner circumference of the refiner discs to their outer circumference. The number of sensor units 22 can of course vary according to the number of measurements considered necessary in the individual case to ensure reliable observations of the variations in the parameters along the path of the pulp. The sensor units may be spaced from one another in a straight line along a radius, as in FIG. 3, or they may be offset concentrically from one another, as in the embodiment shown in FIG. 2, since the relative mutual rotation of the disc causes a lateral movement of the pulp as it progresses outwards towards the outer circumference of the discs. In such a case the lateral displacement of the sensor units 22 will correspond to the estimated movement imparted to the pulp by the rotation of the discs under the operating conditions ordinarily prevailing. Thus the sensor units 22 afford continuous readings of the condition of the pulp throughout its progress along the disc segment 20.

Figure 4:
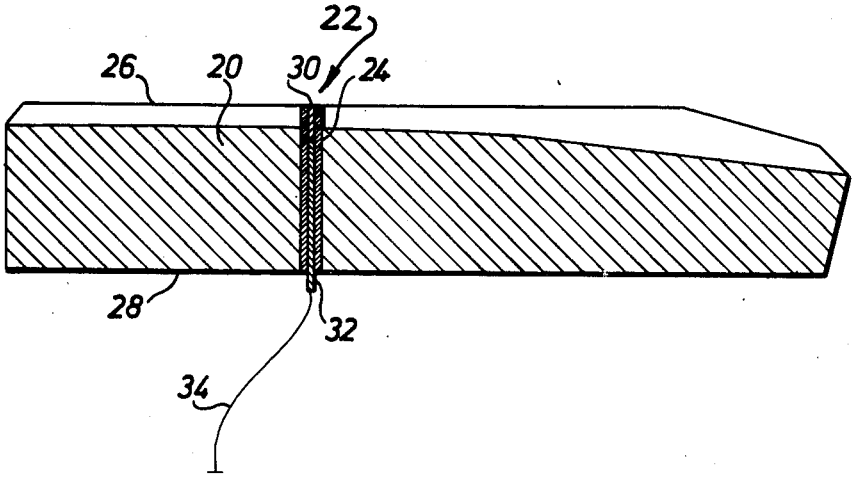
FIG. 4 shows a section through the beating disc of FIG. 2 on a larger scale.

For the sake of simplicity, the embodiment shown refers to the measurement of temperature, although, as stated, other parameters between the discs might also be measured. As can be seen from FIG. 4, which shows a section through part of a disc segment 20 and the sensor unit 22 fitted therein, the latter consists of a bushing 24 of thermal insulant which extends through the disc segment 20 from its front side 26, facing the other disc, to its rear side 28. A thermal conductor element 30, e.g. silver, is inserted in the forward end of the bushing 24, and in direct contact with the conductor element 30 there is a thermocouple 32 or similar device connected to a wire 34. As shown in FIG. 1, the wires 34 from the several sensor units 22 can be connected to a process control center, shown schematically at 36, into which is fed the data from the thermocouples 32 on the one hand, and a refining process control program on the other hand. Wires 38 then run from the process control center to the various regulating points for the process parameters, such as disc clearance setting as exemplified by U.S. Pat. Nos. 3,717,308 to Reinhall, dated Feb. 20, 1973; 3,212,721 to Asplund et al., dated Oct. 19, 1965; and 4,073,442 to Virving, dated Feb. 14, 1978, water feed as exemplified by U.S. Pat. Nos. 3,446,699 to Asplund et al., dated May 27, 1969, and 3,790,092 to Reinhall, dated Feb. 5, 1974, pulp flow regulation as exemplified by U.S. Pat. Nos. 3,847,363 to Reinhall, dated Nov. 12, 1974, and 3,754,714 to Reinhall, dated Aug. 28, 1973. Clearly, the data from the thermocouples 32 can also be presented to be read off conventional indicators or instruments, and the data read off in this way can be used for manual regulation of the refining process if so desired.

The device described works as follows: when fibrous material is being ground in the form of a pulp with water, and with or without chemicals, the greater part (85 to 95 percent.) of the energy input is converted into heat, whereby the water is heated and vaporized. Vaporization will take place whenever the temperature exceeds the vaporization point at the pressure prevailing at any given location between the refiner discs. The more energy supplied per unit weight of pulp, the higher the temperature of the pulp will rise at a given consistency. Similarly, the temperature of the pulp is dependent on the energy transfer per unit surface area of the discs. Therefore, the temperature increase of the pulp is a function of its radial position in the grinding space between the discs. Measurements by means of the sensor units 22 located at varying distances from the center of the grinding discs 16, 18, afford a continuous flow of data on the temperature of the pulp throughout its passage between the discs, and this data can be used to control the refining process.

If the refiner plugs up, i.e. the flow of pulp from the refiner discs 16, 18 ceases, the water supply is no longer sufficient to cool the pulp, and the temperature between the discs rises. This condition is sensed by the units 22 and reported to the process control center (manual or automatic), where the necessary action is taken. The pulp feed rate to the refiner can be reduced or stopped, the disc clearance widened, and extra water fed in the rinse out the space between the discs.

If the pulp feed to the refiner decreases but the load on the refiner discs 16, 18 (measured as the load on the drive motor) is not reduced, the temperature between the discs will rise because the energy per unit weight of pulp will be greater. Similarly, if the pulp flow increases, but the load on the drive motor is not increased, the temperature will drop. If the flow of pulp increases or decreases and the load increases or decreases, the temperature between the discs 16, 18 will change depending on the energy input per unit of weight. In the latter two examples, the energy supply can be restored to its original level by adjusting either the flow of pulp to the refiner or the distance between the discs 16, 18. Another solution as declosed by aforesaid patents is to adjust the water feed rate to achieve a greater or lesser cooling effect.

If the wet content of the pulp entering the refiner (before addition of water) is reduced, the temperature between the discs 16, 18 will rise. Consequently, more water must be added before grinding the pulp. Similarly, the temperature between the discs will drop if the wet content of the pulp increases. A reduction is then required in the amount of water added. Since water can be added both immediately before the refiner discs 16, 18, and also between the discs, the water supply to the various feed points can be controlled with respect to the radial temperature profile of the discs 16, 18. For example, if the temperature rises in the outer zone of the refiner discs, it can be reduced by adding more water between the discs, and vice versa.

Hence, in the operating situations described, the energy transferred to the pulp can be regulated quickly and reliably by using the temperature measurements obtained through the invention as a basis for manual or automatic adjustment of the refining process parameters to eliminate the abovementioned unwanted situations and other similar ones which can be expected to arise in the process of refining.

It is evident that the embodiment illustrated and described is only one example of a realization of the invention, and that it can be altered and modified within the terms of the following Claims.

Thus, as already stated, the sensor units 22 may be arranged in a straight line along a radius instead of along an arc towards the outer circumference of the disc. As stated, the sensor units may be used for sensing or measuring temperature, pressure, or some other variable that indicates the condition of the pulp and its environment at each individual point along the disc. At the same time it is evident that the refining process may be regulated either in terms of the measured values or merely in terms of the gradient, i.e. the difference between the points, the values not being registered directly.

I claim:

1. In the method of refining pulp in which moisture-containing fibrous raw material is introduced at an adjustable rate of feed into the central portion of an adjustable grinding space defined between a pair of grinding discs which rotate relative to one another within a closed housing and in which grinding space the material is propelled by the centrifugal force created by the rotating discs in a radial path towards the periphery of the discs while being subjected to a grinding operation in an environment of steam generated by the heat quotient of the energy input, the improvement for regulating the mechanical energy input by sensing and recording the heat quotients of the mechanical energy input along the radial path of the material in the grinding space and coordinating the rate of feed and moisture content of the material and the width of the grinding space to the recorded heat quotients to produce a pulp in accordance with a programmed pulping process with minimized energy consumption.

2. In a refining apparatus in which moisture-containing fibrous raw material is introduced at an adjustable rate of feed into the central portion of an adjustable grinding space defined between a pair of grinding discs which rotate relative to one another within a closed housing and in which grinding space the material is propelled by the centrifugal force created by the rotating discs in a radial annular path towards the periphery of the discs while being subjected to a grinding operation in an environment of steam generated by the heat quotient of the mechanical energy input, the improvement for regulating the mechanical energy comprising:

(a) sensor means positioned along the radial path of the pulp material to sense the heat quotients of the energy input produced by friction in the grinding space;

(b) means for recording the sensed heat quotients; and (c) means for coordinating the rate of feed and moisture content and width of the grinding space to the recorded heat quotients to produce a pulp in accordance with a programmed pulping process with minimized energy consumption.

* * * * *